US006132115A

United States Patent [19]

Insley et al.

[11] Patent Number: 6,132,115

[45] Date of Patent: Oct. 17, 2000

[54] PRINTER WITH A MOVABLE PRINT HEAD

[75] Inventors: Mark Brian Insley, Gwent; Philip John Thomas, Skelmersdale, both of United Kingdom

[73] Assignee: Illinois Works Inc., Glenview, Ill.

[21] Appl. No.: 09/280,560

[22] Filed: Mar. 30, 1999

[30] Foreign Application Priority Data

Mar. 31, 1998 [GB] United Kingdom ..... 9806965

[51] Int. Cl.[7] ..... B41J 11/20

[52] U.S. Cl. ..... 400/56; 400/232

[58] Field of Search ..... 400/56, 223, 225, 400/229, 232

[56] References Cited

U.S. PATENT DOCUMENTS

| | | | |
|---|---|---|---|
| 4,558,963 | 12/1985 | Applegate et al. | 400/232 |
| 4,728,206 | 3/1988 | Mori et al. | 400/232 |
| 4,787,763 | 11/1988 | Kondo | 400/232 |
| 5,157,413 | 10/1992 | Nagato et al. | 400/232 |
| 5,248,993 | 9/1993 | Oshino et al. | 400/232 |
| 5,429,443 | 7/1995 | Kobayashi et al. | 400/232 |
| 5,816,719 | 10/1998 | Palmer | 400/232 |
| 5,908,251 | 6/1999 | Buckby | 400/232 |

FOREIGN PATENT DOCUMENTS

| | | |
|---|---|---|
| 2 301 559 | 12/1996 | United Kingdom . |
| 2 302 523 | 1/1997 | United Kingdom . |
| 2 306 916 | 5/1997 | United Kingdom . |
| 2 315 244 | 1/1998 | United Kingdom . |

*Primary Examiner*—Eugene Eickholt
*Attorney, Agent, or Firm*—Lowe Hauptman Gopstein Gilman & Berner

[57] ABSTRACT

A thermal printer has a multiple element print head which is movable relative to a platen in a printing stroke to transfer ink from a ribbon to a substrate film sandwiched between the print head and the platen. The print head is mounted so as to be movable across the platen in the printing stroke and in a return stroke, and towards and away from the platen at the beginning and end of the printing stroke respectively, The print head is driven by a print head drive mechanism including and electric motor. The motor is so coupled to the print head as to cause it to execute each of the above-described print head movements. During the printing stroke, the ribbon is moved in the same direction as the print head.

12 Claims, 3 Drawing Sheets

PRINTER WITH A MOVABLE PRINT HEAD

FIELD OF THE INVENTION

This invention relates to a thermal printer with a multiple element print head which is movable across a platen in a printing stroke.

BACKGROUND OF THE INVENTION

British Patent Application No. 2301559 discloses a thermal printer in which a thermal print head is driven in a longitudinal printing stroke across a substrate material supported by a stationary platen. A ribbon coated with thermally transferable ink passes between the print head and the substrate so that when the print head passes across the ribbon with its elements energised and in contact with the ribbon, ink is transferred from the ribbon to the substrate material. At the end of the printing stroke, the head is lifted away from the platen and driven back in a return stroke, whereupon it is lowered again towards the platen to begin another printing stroke. The substrate material is moved intermittently in that it is held stationary during the printing stroke and then advanced during the reverse movement of the print head to bring a new printing area into registry with the platen and the print head. During the printing stroke, the substrate material and the ribbon are maintained stationary on the platen. During the return stroke, both ribbon and substrate material are fed across the platen in readiness for the next printing stroke.

One factor in the operation of all such printers is running costs. One of these costs is the need regularly to replace the thermal ribbon which is consumed during printing.

It is an object of the present invention to reduce ribbon consumption.

SUMMARY OF THE INVENTION

According to a first aspect of the invention, a thermal printer comprises a platen for supporting a substrate on which information or a pattern is to be printed, a multiple element print head mounted so as to be movable across the platen in a printing stroke and a return stroke and towards and away from the platen at the beginning and end of the printing stroke respectively, means defining a ribbon path passing between the print head and the platen and ribbon drive means which operate in use, to drive ribbon along the ribbon path during the printing stroke of the print head.

In a method aspect of the present invention, a method of operating a thermal printer including a platen for supporting a substrate on which information or a pattern is to be printed, a multiple element print head mounted so as to be movable across the platen in a printing stroke and a return stroke and towards and away from the platen at the beginning and end of the printing stroke respectively, means defining a ribbon path passing between the print head and the platen and ribbon drive means operable to drive ribbon along the ribbon path, comprises causing the ribbon drive means to drive ribbon along the ribbon path during a printing stroke.

Preferably, the ribbon is driven in generally the same direction across the platen as the print head during a printing stroke.

ADVANTAGEOUS EFFECT OF THE INVENTION

By arranging for the ribbon to be driven during a printing stroke, a smaller area of ribbon comes into contact with the print head during a printing stroke. The effect of this is to reduce the size of the image formed on the ribbon by removal of ink onto the substrate thereby reducing the consumption of ribbon during printing.

It might be thought that the quality of the image printed on a substrate would be degraded by moving the ribbon in this way. However, the applicant has realised that due to smudging and compression of the image on the ribbon, more ink per unit area is removed from the ribbon than in the prior art arrangement. It will be appreciated for example, that since the printed image is made up of adjacent dots, some ink is left on the ribbon between dots in the conventional arrangement. Thus the present invention achieves more efficient transference of ink from the ribbon to a substrate which results in a reduction in ribbon consumption.

As the speed of the ribbon approaches that of the printing head, the quality of the printed image deteriorates. Thus, preferably the ribbon drive means is arranged to drive the ribbon at a speed less than the speed of movement of the print head across the platen during a printing stroke. Typically, the ribbon drive means is arranged to drive the ribbon at a speed of generally one half of the speed of movement of the print head across the platen during a printing stroke.

BRIEF DESCRIPTION OF THE DRAWINGS

The invention will now be described by way of example with reference to the drawings in which.

DETAILED DESCRIPTION OF THE INVENTION

Figure 1:
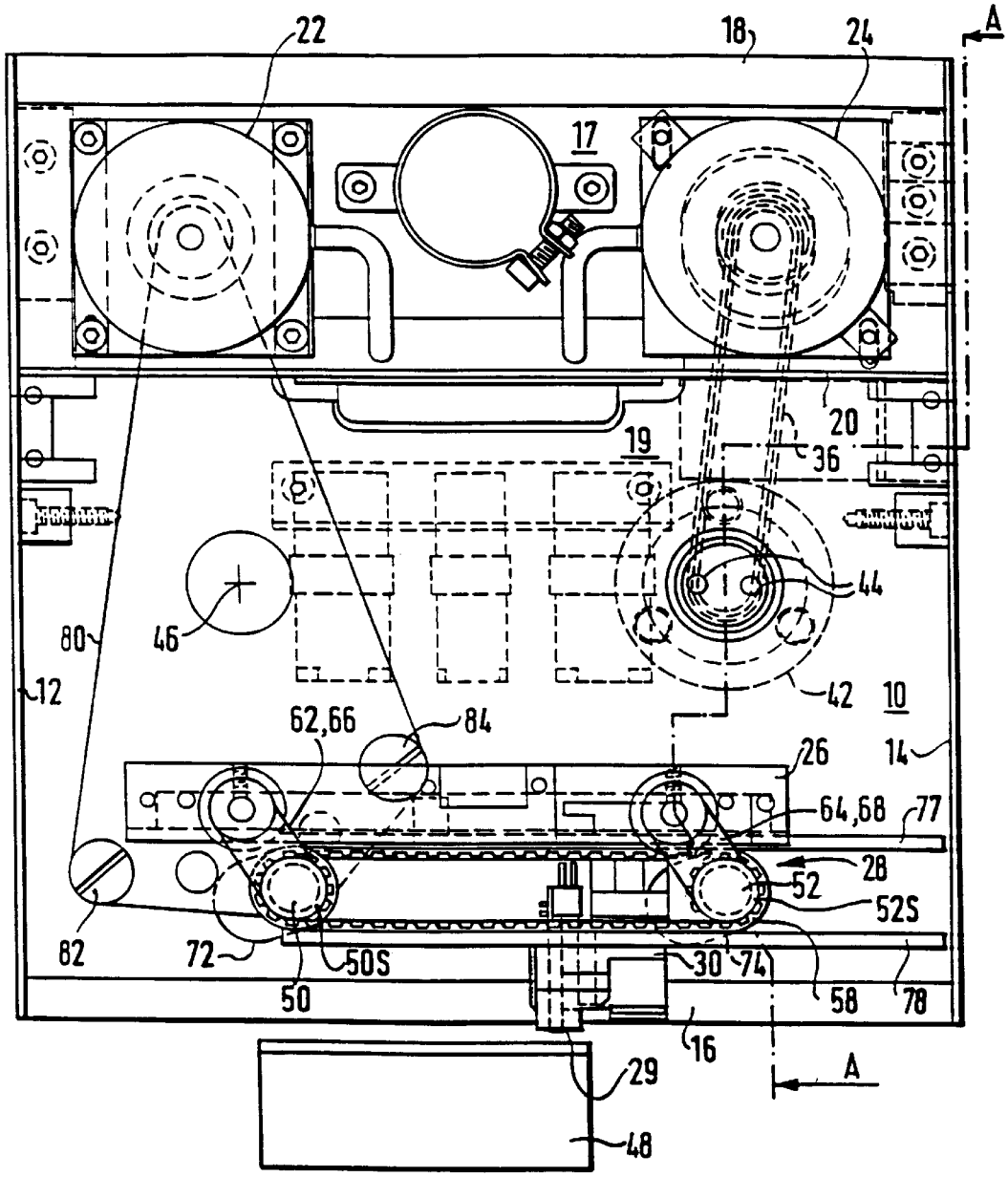
FIG. 1 is a diagrammatic front view of a printer in accordance with the invention with the print head raised.

The printer shown in the drawings is designed to print onto a substrate disposed upon a platen. Printing is effected by transferring ink from a ribbon onto the substrate using a thermal print head which employs a multiplicity of individual heating elements adapted to be selectively energised to produce a fine deposition of ink from the ribbon on the substrate.

In the embodiment illustrated, the print head is positioned above the ribbon and substrate, and when not printing, the head is spaced from the ribbon and applies no pressure to the ribbon or to the substrate so that both ribbon and substrate are free to move relative to each other and to the print head. The platen, which may be coated with rubber or the like, is disposed below the substrate and remains in a substantially static position during operation of the printer. For printing purposes, the ribbon and substrate are sandwiched between the printer head and the platen and the print head is moved down into contact with the ribbon so as to apply a predetermined pressure to the ribbon and the substrate. During a printing stroke in which the print head is moved longitudinally across the ribbon, the required pressure or load is maintained to grip the ribbon and substrate and to ensure good print quality. In accordance with the invention both the up and down movement and the movements in the longitudinal direction are effected by a single electric motor, preferably a stepper motor.

Figure 2:
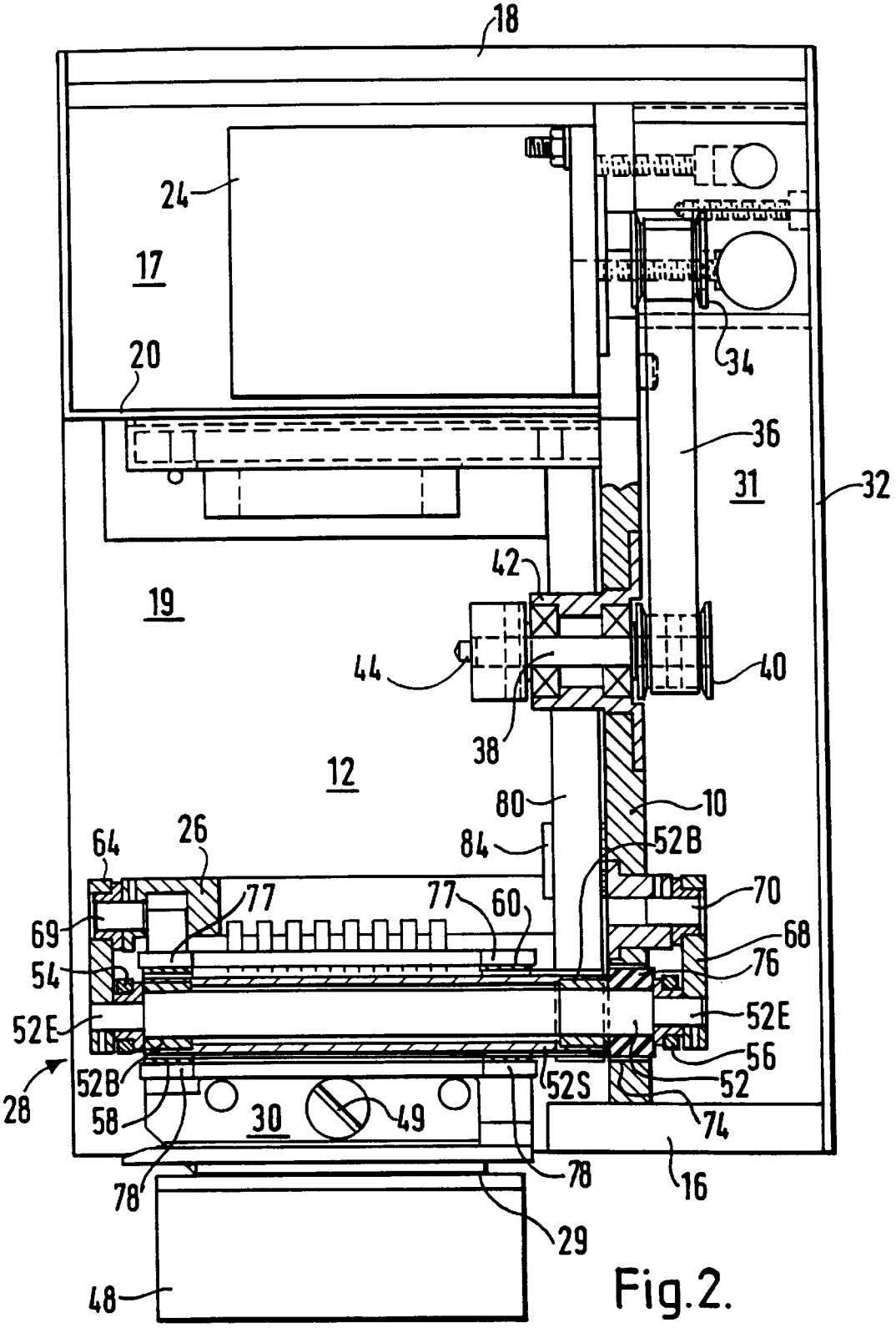
FIG. 2 is a side view, partly sectioned along the line A—A in FIG. 1, with the print head lowered.

Referring to FIGS. 1 and 2, the main components of the printer are mounted on a vertical back plate 10 to which are attached side plates 12,14, a bottom plate 16, and a top plate 18. The space between the side plates 12 and 14 to the front of the back plate 10 is divided into two compartments 17,19 with a partition 20. Above the partition 20 is a motor compartment 17 housing two stepper motors 22,24, while below the partition there is a cantilevered support frame 26 attached to the back plate 10, the support frame 26 mounting a movable print head 29 and a carrier assembly 28 to which a print head carriage 30 is attached. Carriage 30 houses a multiple-element print head 29 which has a series of electrically energisable thermal printing elements extending laterally, i.e. in a line perpendicular to the back plate 10. The print head 29 is fixed in the carriage 30 and the elements are exposed to the underside.

The lower compartment 19 also has space above the support frame 26 for ribbon supply and take-up spools which are not shown, these being part of a front plate assembly (also not shown) which is removable from the side plates 12,14.

Behind the back plate 10 is a third compartment 31, closed off by a rear cover 32. The output shaft of motor 24 projects into this compartment 31 (FIG. 2) and has a drive pulley 34 around which is wrapped a ribbon drive belt 36 for transmitting drive from the motor 24 to a ribbon spindle 38 via a pulley 40, the spindle 38 being mounted in a bush 42 housed in the back plate 10. When the front plate assembly mentioned above is fitted to the side plates 12,14, the ribbon take-up spool, which is mounted on a bearing on the front plate, engages with spigots 44 projecting from the ribbon drive spindle 38.

The ribbon supply spool (not shown), also attached to the front plate, is located alongside the take-up spool, and when the front plate is mounted to the side plates 12,14, is centered on the axis 46 shown in FIG. 1.

It will be understood, that the ribbon, when located in the lower compartment between the side plates 12,14, extends from the supply spool around bars (not shown) attached to the front plate, and thence beneath the print head carriage 30, around one or more further deflecting bars (not shown), and is collected at the take-up spool in the right-hand side of the lower compartment 19.

The motor compartment 17 and the rear compartment 31 are substantially sealed to prevent the ingress of dirt. The electronics controlling the motors are preferably located in an external unit.

A flat platen 48 is fixed beneath the print head carrier assembly 28 to act as a support for the substrate material on which information or patterns are to be printed. By allowing the print head carriage 30 to pivot about a longitudinal axis 49 (see FIG. 2), misalignment of the platen 48 can be obviated.

The mechanism which drives the print head carriage 30 both across the platen 48 and up and down with respect to the platen 48 will now be described in more detail.

Referring to both FIG. 1 and FIG. 2, the print head carrier assembly comprises two parallel shafts 50,52 with axes perpendicular to the back plate 10, front and rear connecting members 54,56 (see FIG. 2) linking the front ends and the rear ends respectively of the shafts 50,52, and front and rear looped drive belts 58,60 which are wrapped around the shafts 50,52, and have parallel upper and lower belt runs parallel to the platen 48.

Each shaft 50,52 has a rotatable outer sleeve 50S,52S mounted on the shaft core by bearings (see 52B in FIG. 2), the sleeves 50S,52S being splined to receive the toothed inner faces of the print head drive belts 58,60. Each shaft core has a pin (see 52E in FIG. 2) at each end which not only receives one of the connecting members 54,56, but also is housed in the end of a respective crank arm 62,64,66 or 68. Two of these crank arms 62,64 are pivotally mounted on studs 69 fixed to the front edge of the cantilevered support frame 26, while the other two, the rear two 66,68, are mounted on studs 70 projecting from the rear of the back plate 10 (see FIG. 2). Thus, each shaft 50,52 hangs on a front crank arm 62,64 and a rear crank arm 66,68, the front and rear crank arms supporting each shaft having a common pivot axis. These pivot axes are spaced apart by a distance equal to the spacing of the axes of the shafts 50,52 so that the arms form the sides of a parallelogram, as seen in FIG. 1. It will be noted that each shaft 50,52, passes through a respective slot 72,74 in the back plate 10, the ends of which slots act as stops to limit the degree of angular rotation of the arms. Where the shafts 50,52 pass through the slots 72,74 they have rubber cushioning sleeves 76.

The print head carriage 30 includes two pairs of guide rails 77,78 which lie respectively above and below the print head drive belts 58,60. The lower guide rails 78 are fixed to the belts 58,60 in their lower belt run between shafts 50,52 with the upper guide rail 77 free to slide over the back of the belts 58,60 along the upper belt run.

It will be appreciated from the foregoing that the print head carrier assembly, comprising shafts 50,52 and the print head drive belts 58,60, is movable towards and away from the path of the substrate material as the arms swing in unison, as well as in the printing and return stroke directions, thereby causing the print head 29 alternately to press down against and withdraw from the ribbon and substrate material. The manner in which this approaching and withdrawing movement is brought about will now be described.

Referring to FIG. 2, immediately in front of the back plate 10 is a third belt 80 which transfers drive from the print head drive motor 22 to the print head carrier assembly 28 by virtue of the belt also being wrapped around the sleeve 50S of one of the shafts 50 of the carrier assembly. In fact, as can be seen from FIG. 1, this transfer drive belt 80, which is also toothed like the print head drive belts 58,60, wraps around the sleeve 50S over an angle of less than 90° at the axis of shaft 50 so that on each side of shaft 50 it forms a shallow "V" defined by the positions of idler rollers 82,84 mounted on the back plate 10. When the shaft 50 is at the mid-point of its arcuate path of travel, the line joining its axis with the pivot axis of the suspending crank arms 62,66 approximately bisects the angle made by the "V" of the transfer drive belt 80 between the idler rollers 82,84. Each arm of the "V" makes an angle of greater than 50° with the bisecting line, and preferably 60°.

In FIG. 1, the print head carriage 30 is shown in its raised position and approximately at the mid-point of its return stroke. It will be noted that the shafts 50,52 are at the upper ends of the slots 72,74. At this point of the printing cycle, the motor 22 is driven in a clockwise direction so that the shafts 50,52 are driven in an anti-clockwise direction and the print head carriage is being driven to the right. Due to the frictional resistance against rotation of the shafts 50,52, rotation of the transfer drive belt 80 in the anti-clockwise direction keeps the shafts 50,52 at the ends of the slots 72,74, thereby keeping the print head carriage 30 in the raised or retracted position. When the carriage 30 has reached the end of its return stroke, the print head drive motor 22 is switched to drive in the opposite direction. As a result, transfer drive belt 80 is driven clockwise and arms 62,66,64,68 are immediately swung clockwise so that the shafts 50,52 move to the lower ends of slots 72,74, bringing the print head 29 downwards to an active position so as to apply pressure against the ribbon and substrate material (not shown) lying over the platen 48. Once the shafts 50,52 have reached the limit of their movement along slots 72,74, both are driven clockwise and the print head 29 is caused to move across the platen 30 in its printing stroke with the force applied to the arms 62,66,64,68 by the motor 22 and belt 80 resulting in the print head 29 being pressed against the ribbon and substrate which lie over the platen 48.

At the end of the printing stroke, the print head drive motor 22 is reversed once again to cause transfer drive belt 80 to move anti-clockwise, thereby moving shafts 50,52 to the right again and lifting the print head 29. When the shafts 50,52 have reached their upper limit of movement, they are rotated anti-clockwise by the belt 80 to execute another return stroke.

Figure 3:
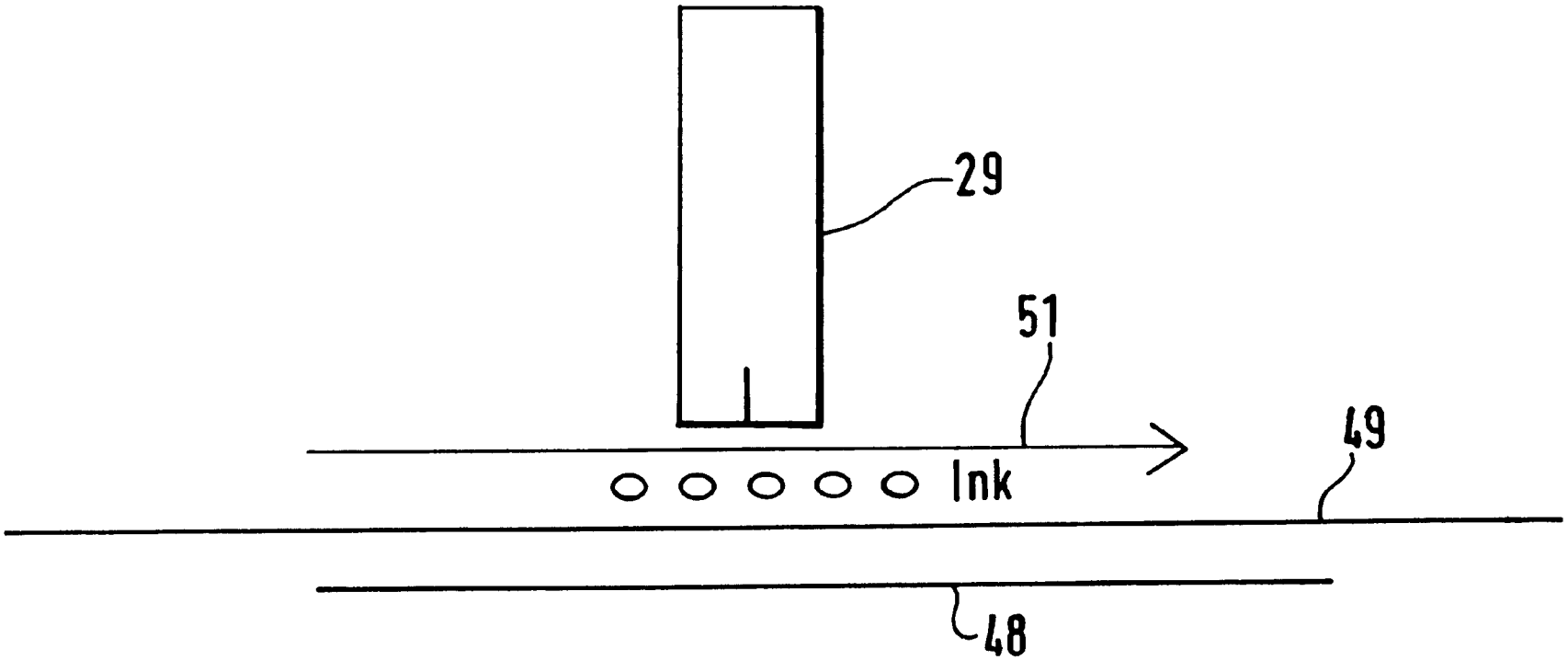
FIG. 3 is a detailed side view of the relationship between the lowered print head, ribbon and substrate in the printer of FIG. 1.

With particular reference to FIG. 3, during the printing stroke, the ribbon 51 is moved relative to the substrate material 49 and the platen 48. This is achieved as described above by rotating ribbon drive spindle 38 to cause ribbon to be wound onto the ribbon take-up spool. The motor 24 which indirectly drives the ribbon take-up spool, rotates at a speed which results in a ribbon speed across the substrate 49 of approximately half the speed of movement of the print head 29 across the platen 48.

During the return stroke, both ribbon and substrate material are fed across the platen 48 towards the right-hand side of the printer as seen in FIG. 1 in readiness for the next printing stroke.

The print head drive motor 22 is a stepper motor which is capable of rapid acceleration. The relatively short periods of acceleration take place largely during the movement of the shafts 50,52 along their respective slots 72,74 so that during the printing stroke the print head drive belts 58,60 and the print carriage 30 are moving with substantially constant velocity.

It will be appreciated that the invention described above is generally applicable to thermal printers in which the printhead is movable across the platen during a printing stroke and is not limited to application with the printer described in detail above.

What is claimed is:

1. A thermal printer comprising:

a platen for supporting a substrate on which information or a pattern is to be printed;

a multiple element print head mounted so as to be movable across the platen in a printing stroke and a return stroke and towards and away form the platen at the beginning and end of the printing stroke respectively;

a cantilevered support frame mounting said multiple element print head and a carrier assembly to which a print head carriage is attached, said carrier assembly including two parallel shafts, front and rear connecting members linking front ends and rear ends respectively of said shafts, and front and rear looped drive belts which are wrapped around the shafts and have parallel upper and lower belt runs parallel to the platen, each shaft passing through a respective slot in a support frame, the ends of which slots act as stops to limit the degree of angular rotation of arms supporting the shafts such that the print head drive belts are movable towards and away from the path of the substrate material as the arms swing in unison as well as in the printing and return stroke directions to cause the print head to alternately press down against and withdraw from the ribbon and substrate material;

a path defining arrangement mounted to define a ribbon path that passes between the print head and the platen; and a ribbon drive arranged to drive a ribbon along the ribbon path during the printing stroke of the print head.

2. A thermal printer according to claim 1, wherein the substrate is arranged to be stationary during a printing stroke.

3. A thermal printer according to claim 1, wherein the ribbon drive is arranged to drive the ribbon at a speed less than the speed of movement of the print head across the platen during a printing stroke.

4. A thermal printer according to claim 3, wherein the ribbon drive is arranged to drive the ribbon at a speed of generally one half of the speed of movement of the print head across the platen during a printing stroke.

5. The thermal printer of claim 1, wherein each of the parallel shafts has a rotatable outer sleeve mounted on a shaft core by bearings, said sleeves being splined to received toothed inner faces of the print head drive belts, each shaft core having a pin at each end which not only receives one of said connecting members but also is housed in the end of a respective crank arm.

6. The thermal printer of claim 5, wherein two of said crank arms are pivotably mounted on studs fixed to the front edge of the cantilevered support frame while a rear two of said crank arms are mounted on studs projecting from a rear of the support frame, whereby each shaft hangs on a front crank arm and a rear crank arm that support each shaft and have a common pivot axis, said pivot axes being spaced apart by a distance equal to the spacing of the axes of the shafts so that the arms form the sides at a parallelogram.

7. The thermal printer of claim 6, wherein each shaft passing through the respective slot in the support frame utilize ends of the slots to act as stops that limit the degree of angular rotation of the arms.

8. The thermal printer of claim 7, further including resilient cushioning sleeves cushioning the shafts passing through said slots.

9. The thermal printer of claim 7, wherein said print head carriage includes two pairs of guide rails which lie respectively above and below the print head drive belts, the lower guide rails being fixed to the belts in their lower belt run between said shafts with the upper guide rail free to slide over the back of the belts along the upper belt run.

10. The thermal printer of claim 9, further comprising a third belt which transfers drive from a print head drive motor to the print head carrier assembly by virtue of the belt being wrapped around the sleeve of one of said shafts of said carrier assembly.

11. The thermal printer of claim 10, wherein said third belt is toothed and wraps around the sleeve at an angle of less than 90° at the axis of the shaft so that on each side of the shaft there is formed a shallow V defined by positions of idler rollers mounted on the support frame.

12. The thermal printer of claim 11, wherein when the shaft is at a mid-point of its arcuate path of travel, a line joining its axis with the pivot axis of the suspending crank arms approximately bisects the angle made by the V of the third belt between the idler rollers.

* * * * *